United States Patent [19]

Wright et al.

[11] Patent Number: 4,901,870

[45] Date of Patent: Feb. 20, 1990

[54] SPACER FOR SUPPORT OF CYLINDRICAL ROLLS

[76] Inventors: Tim E. Wright; Catherine E. Helten, both of P.O. Box 1407, both of Pasco, Wash. 99301

[21] Appl. No.: 270,367

[22] Filed: Nov. 14, 1988

[51] Int. Cl.[4] ..... A47F 7/00

[52] U.S. Cl. ..... 211/59.4; 211/60.1; 206/446

[58] Field of Search ..... 211/60.1, 70.4, 59.4, 211/74; 206/446, 386, 485, 3

[56] References Cited

U.S. PATENT DOCUMENTS

| | | | |
|---|---|---|---|
| 1,892,993 | 12/1932 | Gray . | |
| 2,527,993 | 10/1950 | Habler . | |
| 2,715,458 | 8/1955 | Polglase . | |
| 2,718,303 | 9/1955 | Polglase . | |
| 2,930,562 | 3/1960 | King . | |
| 3,357,305 | 12/1967 | Clute et al. | 206/3 X |
| 3,501,018 | 3/1970 | Solo | 211/60.1 |
| 3,581,929 | 6/1971 | Guenard et al. | 211/60.1 X |
| 4,435,463 | 3/1984 | Roellchen . | |
| 4,610,362 | 9/1986 | Remp et al. | 211/60.1 X |

*Primary Examiner*—Blair M. Johnson
*Attorney, Agent, or Firm*—Keith S. Bergman

[57] ABSTRACT

A spacing and support module is disclosed for use in groups to support an array of spaced, axially parallel cylinders for transport and storage. The support module on one side defines plural indentations having thickened indented portions that deform during use to add strength in the indented areas. A species of the spacing module provides a sheet-like reinforcing element on the side not defining indentations or between two support elements having their non-indentation defining surfaces immediately adjacent both sides of the reinforcing element. The module is especially useful in supporting palletized arrays of rolls of web material or pipes of delicate nature.

8 Claims, 1 Drawing Sheet

SPACER FOR SUPPORT OF CYLINDRICAL ROLLS

II. BACKGROUND OF INVENTION

IIA. Related Applications

There are no applications related hereto heretofore filed in this or any foreign country.

IIB. Field of Invention

Our invention relates generally to spacing and support modules for spacedly arrayed elongate cylindrical materials and more particularly to such modules that have thickened, deformable indented portions and reinforced surfaces.

IIC. Background and Description of Prior Art

Rolled web material, piping and similar cylindrical objects must commonly be dealt with in the present day packaging arts especially for transportation and storage. Much of this material is of a relatively delicate and expensive nature and it may become substantially worthless if it be physically damaged in even small portions of its total volume to exacerbate problems of supporting and protecting the material. Commonly, the material is handled in palletized arrays comprising a plurality of cylinders in spaced axially parallel alignment so arrayed as to form plural horizontal rows and vertical columns. Many and various spacers and supports for such arrays have heretofore become known. Our invention provides a new, novel and improved member of this class of supports.

Such supports as heretofore known have had various problems with their physical integrity. In general, such supports have taken a configuration of a cross element defining plural spaced saddle-like indentations to support usually the lower half of the peripheries of a series of spaced cylinders. Necessarily such configuration requires the support members to have a thinner portion at the point of cylinder support and because of this the support point has been the weakest portion of the supports. Commonly in arraying a plurality of cylinders in a supported module, the cylinders are, for convenience or by custom, aligned with parallel axes and in planar columns and planar rows. This configurational array tends to further enhance the problem of support integrity, as commonly the weakest points of a plurality of cross supports are aligned in vertical columns which tends to increase the potential of physical corruption of the support structures.

The problem is further increased by the nature of the materials from which such supports are formed. Commonly to be useful for their purpose, support elements must be formed of some relatively soft, resilient material so that they will not physically damage material that they are to support. One of the more common materials preferred in present day commerce for such purposes is traditional unified foamed polystyrene pellet material. Any consolidated foamed polymeric material in general, and the styrene material in particular, tends to be compressed somewhat by the weight of cylinders of material that it supports and when this styrene material is arrayed in vertical columns, the weight of supported material tends to be somewhat additive to further enhance the compression. As the support material compresses, it becomes thinner and generally decreases in strength to again increase the potentiality of physical corruption of the support modules.

If the support elements are physically corrupted and do not maintain the array of a group of cylinders oftentimes even with strapping on a pallet, the arrayed cylinders will move sufficiently from their predetermined positions to cause damage to the supported material. If groups of such arrayed material are stacked vertically, the problem is enhanced as a lower portion of the material may move sufficiently to cause an upper portion to become positionally unstable and fall or break its strapping to further damage the amassed array. Our invention solves these problems by presenting a new and novel spacing support for such elongate cylindrical materials.

We provide an elongate rectilinear cross support defining one surface with plural cavities to contain somewhat less than half of the periphery of a plurality of spaced cylinders of material aligned with parallel axes in spaced planes perpendicular as heretofore done. In finer structure, however, our cross-supports differ from the prior art by providing a bridge of material extending into the cylinder cavities in their thinnest portions which support the weight of a cylinder. Preferably the size and thickness of this bridge material is determined functionally relative to the mass of the cylinders to be supported and the compressability of the materials involved so that the weight of the cylinders compress the material sufficiently so that the ultimate surface substantially conformally fits the surface of a cylinder to be supported. This bridge material may be variously configured to accomplish its purpose, but normally for cylindrical material it takes the shape of an upwardly rising arch of a cross-sectional shape of a circular sector.

Our bridge element tends to solve multiple problems existent in prior supports. Firstly, it allows use of softer, fairly compressible materials by making use of their compressive characteristics to enhance their function rather than to detract from it. The material in the bridge area is compressed so that the ultimate support configuration is maintained to support a cylinder conformally about part of its periphery. Secondarily, the compressed material in the support area provides enhanced resilience for nondamaging support, but at the same time, the material is not thinned as it was in the past, so that it has higher strength, both in shear or compression, to maintain its structural integrity.

In a specie of our invention, the flat surface of a support opposite that defining its indentations is provided with a sheet of reinforcing material that is thinner than the support, but of substantially greater strength. Such material commonly will take the form of a fiberboard material, such as the more durable cardboards or pressboards, a plastic, or some combinations of these materials, though it may also include wood. The reinforcing material preferably is adhered to the flat surface of the support to add its physical strength and rigidity to the compound support member so formed to further enhance potential durability and strength.

For medial support modules that are positioned between two vertically adjacent layers of cylindrical material, two support elements may be positioned on opposite sides of a reinforcing sheet to share that sheet in common. This configuration provides the same general benefits as provided by individual support with a backing element, but also has the added benefit of adding further structural integrity to an amassed array of supported cylinders of material, as this configuration tends to prevent adjacent supported layers of material from moving in a horizontal plane relative to each other, and especially in a lateral fashion parallel to the axis of cross supports.

Our invention resides not in any one of these features per se, but rather in the synergistic combination of all of them to give rise to the structures of our invention and the functions necessarily flowing therefrom as hereinafter more fully specified and claimed.

III. SUMMARY OF INVENTION

Our invention provides a support and spacing element to positionally maintain and protect a plurality of cylinders of material in spaced array.

The support is an elongate element having one longer planar surface with the opposite surface configured to define plural spaced indentations to accept cylindrical material. The lowermost portions of the indentations define bridging elements to add additional strength and upon deformation provide a conformal fit with the peripheral surface of a cylinder being supported. The support is formed of a relatively soft, semi-resiliently deformable material, such as unitized foamed polystyrene particles.

A species of our invention provides a rigid sheet of reinforcing material on the flat elongate surface opposite the surface defining indentations to provide additional strength and rigidity. Two similar supports, to be used in the medial portion of a stacked array of cylinders of material, may share such a reinforcing sheet by being attached to opposite sides thereof.

In providing such a device, it is:

A principal object of our invention to create an elongate cross-support and spacing element for cylindrical material to spacedly maintain a plurality of such materials in an array having horizontal layers and vertical columns for transport or storage, such as on a pallet.

A further object of our invention to provide such a support that defines plural spaced indentations to conformably fit about somewhat less than half of the periphery of a cylinder to be supported with bridge elements in the indentations to aid in providing conformal support of cylinders upon weight deformation of the bridges to add strength in the thinnest parts of the support.

A still further object of our invention to provide such a support that may have a sheet-like reinforcing element adhered to the surface opposite the surface defining indentations to provide additional strength, rigidity and durability.

A still further object of our invention to provide two such support structures that share a common reinforcing element for use in a medial portion of a stacked array of cylinders to aid in maintaining conformational integrity of the array, especially from laterally horizontal displacement.

A still further object of our invention to provide such a support that is of new and novel design, of rugged and durable nature, of simple and economical manufacture and is otherwise well suited to the uses and purposes for which it is intended.

Other and further objects of our invention will appear from the following specification and accompanying drawings which form a part hereof. In carrying out the objects of our invention, however, it is to be understood that its features are susceptible of change in design and structural arrangement with only one preferred and practical embodiment being illustrated in the accompanying drawings as is required.

IV. BRIEF DESCRIPTION OF DRAWINGS

In the accompanying drawings which form a part hereof and wherein like numbers of reference refer to similar parts throughout:

V. DESCRIPTION OF THE PREFERRED EMBODIMENT

Figure 2:
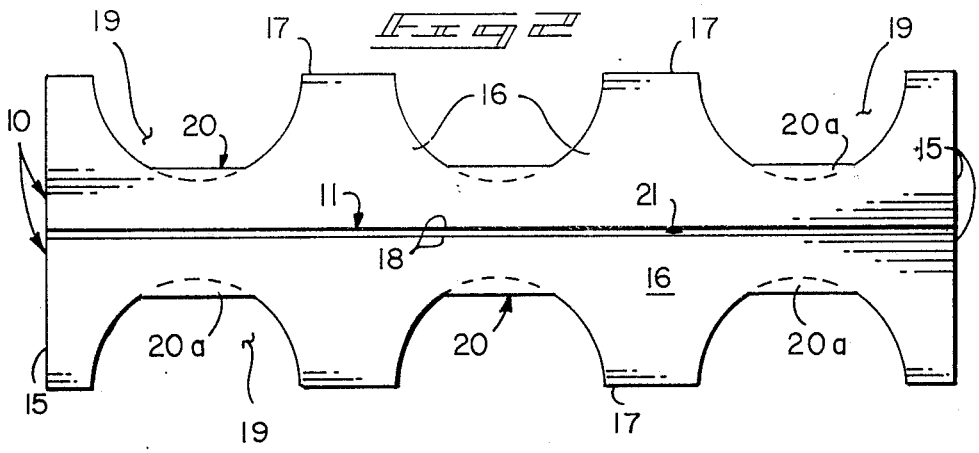
FIG. 2 is an orthographic side view of two supports adhered to opposite sides of a common, more rigid reinforcing element.

My invention provides a plurality of supports 10, which may have rigid reinforcing members 11, to support a spaced array of cylinders of material 14 on pallet 12 as aided by strapping 13.

Support 10 is an elongate rectilinear element formed with similar opposed ends 15 and sides 16, indentation defining surface 17, and opposite planar back surface 18. The length of the support parallel to side 16 defines the lateral dimension of a stacked array of cylinders commonly for use with ordinary sized pallets will be substantially 48 inches. The width of the support, that is the perpendicular dimension between sides 16, is not critical nor is the thickness, but both necessarily must be defined in functional relationship to the nature of the materials from which a support is formed and of the nature of cylinders that are to be supported to allow proper functioning as hereinafter described. Obviously, the vertical dimension between surfaces 17 and 18 must be somewhat greater than half of the diameter of cylinders to be supported in order to allow definition of indentations and yet maintain the structural integrity of the support.

Surface 17 of each support defines indentation 19, generally of the same size and configuration as the peripheral surface of a cylinder of material to be supported. The size may be slightly smaller or larger then that material to adjust the exact nature and conformity of fit between the two elements and in certain specialized cases, the configuration of indentation may be somewhat different than that of a supported cylinder to provide a particular type of support at particular positions on the two associated elements. In general, however, the most efficient support is provided by a conformal fit between a support and a cylinder being supported over as large an area of the adjacent surfaces as possible.

The exact positioning of indentations 19 in a support is not particularly critical, but should in general be such as to provide some horizontal space between cylinders to be supported and should leave a sufficient web of material beneath a supported cylinder to provide necessary strength rigidity for the support element itself. Normally, the definition of indentations will be symmetrical in two dimensions about a medial point on the elongate axis so that identical support structures may be positioned back to back to support an array of cylindrical material with the various elements of a particular layer in vertically stacked array. This configuration also allows the same support element to be used with its indentation defining surface oriented either upwardly or downwardly and also configures the stacked array in the fashion that is most commonly desired for transportation and storage.

Figure 3:
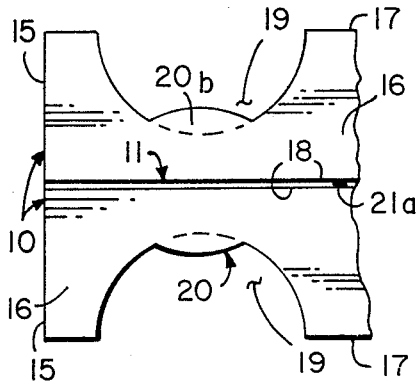
FIG. 3 is a partial orthographic side view of the same type of support structure as shown in FIG. 2, except the indentations have arched reinforcing bridges.
Figure 4:
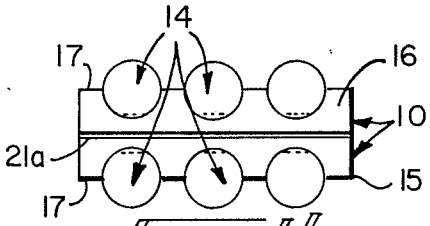
FIG. 4 is an orthographic end view of a medial support element of FIG. 5 showing the bridges of that support member deformed as would occur upon placement of cylindrical material thereon.
Figure 5:
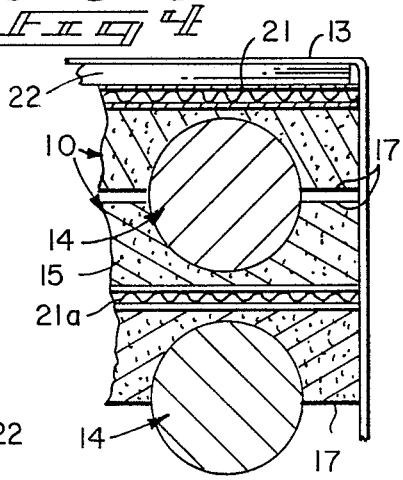
FIG. 5 is a somewhat enlarged partial vertical cross-sectional view through a portion of the stacked array of rolled web material of FIG. 1, taken on the line 5—5 in the direction indicated by the arrows thereon.

Each indentation 19 defines in its medial innermost portion a bridge element 20. The type of bridge element illustrated in FIG. 2 provides a sector 20*a* defined by a plane parallel to the axis cutting the periphery of a cylindrical surface, and the element illustrated in FIG. 3 provides an arcuate bridge 20*b* extending in curvilinear fashion outwardly from the innermost portion of a cylinder indentation. The thickness of the bridge, that is the distance perpendicular to surface 17 that the bridge extends into an idealized indentation that would conformally fit upon the periphery of a cylinder to be supported, is functionally related to a particular support situation. In general, this bridge thickness is such that with the given materials from which a support element is formed and the weight of a particular cylinder to be supported, the bridge will deform substantially to a configuration that will conformally support the particular cylinder of material. This configuration may be determined by application of known engineering methods to the physical parameters involved or may be determined empirically by experimentation with particular materials. Commonly this dimensioning will be substantially in the proportions illustrated in the accompanying drawings.

The material from which our support elements are formed must have sufficient strength and rigidity to fulfill its support and separation functions, but yet must also be somewhat resiliently deformable to properly support rolled material without causing damage to it. A fairly ideal material for this purpose, and one that has heretofore become known for similar purposes in the packaging arts, is formed of consolidated particles of polymeric material and particularly foamed polystyrene. This material may be prepared in various forms providing different composite physical characteristics of strength, rigidity, deformability and the like, functionally depending largely upon the size of particles from which the material is formed, the degree of foaming, cell structure, and particle compaction, all of which generally are functionally related to the density of the product. Other materials may fulfill the requirements of our invention, if not so well, but the physical characteristics of the material must be fairly accurately related to the parameters specified for the material to be completely, or even practically, operative in our support. Some forms of consolidated fibrous materials and particulated vegetative materials, especially as heretofore known and used in the packaging arts, may serve our requirements. The material used is formed to the particular configuration specified by ordinary methods heretofore known, such as by molding or cutting to the indicated configurations.

A species of our invention provides a rigid reinforcing member 11 attached to surface 18 of our support. This reinforcing member is a sheet-like element 21 formed of stronger and more rigid material than that of which the support itself is formed. Element 21 is of the same size and shape as surface 18 of an associated support and has a thickness somewhat less than the thickness of the support and generally less than ¼ of that support thickness. The back element preferably is fastened in surface adjacency to support surface 18 by adhesion with adhesives commonly used in the present day packaging arts for adhering consolidated particulate styrofoam forms to more rigid materials, though undoubtedly other means of mechanical fastening, such as staples, nails or similar devices might be used. Mechanical fasteners, if used, must be properly positioned so that they will do no damage to supported rolls of web material when the supports be normally configured, deformed or otherwise moved.

The material of preference for back elements 21 is a paperboard product of commerce formed with spaced planar surfaces joined by medial corrugated webbing extending therebetween and fastened thereto. Such a product provides substantial additional strength to a support in either compression or extension, but yet is relatively thin, light and has some flexibility or resilience to allow limited motion of a support member and its associated structures. Other similar sheet materials, such as compressed particle board, matted fiber board and various sheet plastics in solid or configured forms, may be used for this purpose, but generally are no better in performance and are more expensive than paperboard.

A third species of our invention is shown in the illustration of FIG. 3 where two support elements are joined on opposite sides to a common rigid back element. This back element 21*a* is of the same nature, size and configuration as previously described and is attached to each support element in the same manner as heretofore described. This species of support is useful in the medial portion of a stacked array of cylindrical material to provide support for the lower portion of an upper layer and the upper portion of an adjacent lower layer of cylinders, but yet maintain a consolidated array, no part of which generally may move relative to any other part, whereas if two separate supports be used, whether they have backs or not, the two might move relative to each other, particularly in a plane through the adjacent backs. The support function of this third species of our invention is the same as previously described for the other versions, except that it tends to add structural integrity to a stacked array of cylinders more than the other species.

Figure 1:
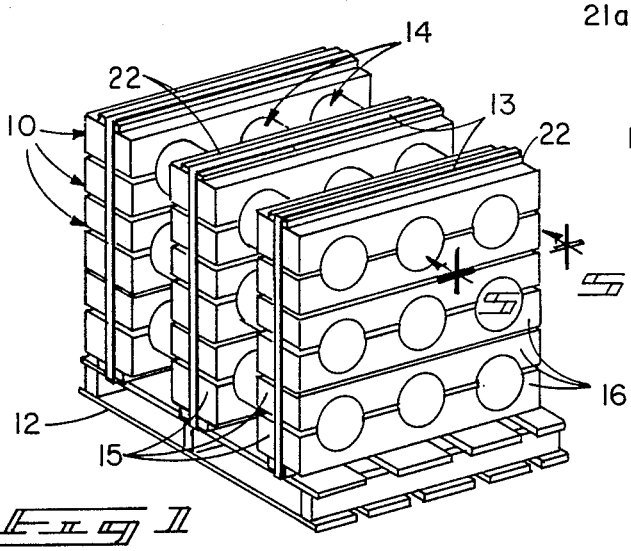
FIG. 1 is an isometric view of a stacked array of cylinders of rolled web material supported by the supports of our invention upon a strapped pallet.

Having thusly described the structure of our invention its use may now be understood, particularly with reference to FIG. 1 which shows a plurality of the supports of our invention used to support an array of cylindrical rolls 14 of web material on pallet 12. At least two, and selectively more, supports 10 are positioned on the pallet, with their planar back surfaces 18 downward and their indentation defining surfaces 17 upward, in spaced relationship so that at least one support is positioned near each end of rolls to be supported. Various end structures (not shown), as heretofore known in the packaging arts, may be provided in the support indentations to assure a particular alignment of the ends of rolls within the support structures, prevent their axial motion relative to the supports, and in a position to protect the ends of such rolls. If medial supports be used, those medial supports are spacedly positioned between the two end supports. With supports so positioned, a row of rolls is then established on the supports and in indentations 19 defined therein. An additional layer of supports are then positioned vertically above the first layer with their indentation defining surfaces downward. If the supports be individual elements, two supports in back to back relationship are positioned above each support of the first layer and if the supports be of the specie of FIG. 3, a single connected unit is positioned on the first layer of roll material. A second layer of rolls of material is then added and the process continued in similar fashion until the stacked array of supports and rolls of material has in position the last and uppermost layer of rolls to be supported. Single supports are then positioned on top of the upper layer of rolls, vertically above each of the support columns therebeneath, and the array is completed.

Normally if the supported array of rolls is to be maintained on a pallet for any period of time, and especially for any transportation, the load commonly will be fastened to pallet 12 by strapping 13. This strapping may be of the traditional variety heretofore used for such purposes and may optionally include rigid strips 22 between the straps and the adjacent support surfaces, if desired. The load is unitized by the strapping upon the pallet and the straps also tend to provide a means of forceful deformation of any bridging elements in the array of supports that may not previously have been properly deformed. In such an array as described, it is to be noted that loads will be borne by the stacked columns of support elements 10 and transferred by them to a supporting pallet. The forces on the supports essentially will be compressive and no particular extensive forces will be created in the supports or rolls of material.

It is further to be noted that to support cylindrical rolls of material in roll indentations 19, those indentations may not define more than one-half of the periphery of a cylinder to be supported and preferably should define somewhat less of that half periphery to assure that the cylinders are completely supported in the indentations after deformation of the bridging elements extending therein. If the cylinders are not completely supported about a substantial area of their peripheries, the areas of such limited support may receive excessive pressures or forces that may tend to damage material being supported. The engagement of as much as possible of the indentation defining surface of the support with rolled material also increases the overall frictional support of cylinders in the support material, since that frictional support is functionally related to the area of contact between the two elements. The enhanced frictional support between the elements tends to prevent any relative motion during transport or handling, which tends to lessen potentiality of any damage to the rolls.

It is further to be noted that our invention may be used in substantially the same fashion and presents substantially the same amenities as similar prior art cross support devices that do not include its new and novel features.

The foregoing description of our invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described our invention, what we desire to protect by Letters Patent, and

What we claim is:

1. A cross support for a spaced array of a plurality of elongate cylindrical elements such as rolls of sheet material, comprising in combination:

an elongate support of rectilinear cross-section formed of resiliently deformable material and defining a plurality of indentations in one elongate surface, each indentation being arcuate and being defined by a substantially constant radius of curvature and extending through an angle less than 180 degrees, thereby defining a shape of less than half of a cylindrical element to be supported thereby, all of said indentations being defined in parallel spaced adjacency, and a bridging element formed of resiliently deformable material, said bridging element extending substantially the length of each indentation parallel to its axis and further extending a spaced distance into each indentation from the medial innermost portion of the surface defining that indentation to compress to support a cylindrical element carried in an indentation.

2. The invention of claim 1 wherein the bridging element is configured as a sector of a cylinder defined by a plane parallel to the axis of such cylinder.

3. The invention of claim 1 further characterized by the bridging element being of arcuate configuration with the arcuately curved surface of the bridging element extending into an indentation.

4. The invention of claim 1 further characterized by a sheet-like reinforcing back element, carried by the surface of the support opposite the surface defining indentations, to provide additional rigidity and strength.

5. The invention of claim 4 having a second support element attached to the side of the back reinforcing element opposite the side supporting the first support element.

6. The invention of claim 4 wherein the sheet-like reinforcing back element is formed of paperboard of similar size and configuration as the adjacent support, said reinforcing element being fastened in surface adjacency with the support by adhesion.

7. The invention of claim 1 further characterized by:

the support member being formed by consolidated particles of foamed polystyrene.

8. In a cross support for plural spaced cylindrical elements, such as rolls of sheet material, wherein an elongate support formed of resiliently deformable material defines opposed elongate surfaces with one elongate support surface defining plural spaced indentations, each indentation being arcuate and being defined by a substantially constant radius of curvature and extending through an angle less than 180 degrees, thereby defining a shape of less than half of the cross-section of a cylindrical element to be supported in the indentation, the improvement comprising, in combination:

a bridging element formed of resiliently deformable material and extending substantially the length of each indentation parellel to its axis and further extending a spaced distance into each indentation from the medial innermost portion of the surface defining that indentation, said bridging element being compressible by a cylindrical element, carried in that indentation to support the cylindrical element.

* * * * *